US005319879A

United States Patent [19]

Rozycki

[11] Patent Number: 5,319,879

[45] Date of Patent: Jun. 14, 1994

[54] HIGH SECURITY MULTI-PANE WINDOW AND DOOR SYSTEM

[76] Inventor: Jerzy J. Rozycki, 477 Beaver St., Apt. G-10, Ansonia, Conn. 06401

[21] Appl. No.: 967,724

[22] Filed: Oct. 29, 1992

[51] Int. Cl.[5] ..... E05B 65/04

[52] U.S. Cl. ..... 49/61; 49/50; 52/106

[58] Field of Search ..... 49/50, 501, 504, 61; 52/204.1, 207, 106

[56] References Cited

U.S. PATENT DOCUMENTS

| | | | |
|---|---|---|---|
| 1,788,928 | 1/1931 | Mills | 49/50 |
| 2,132,217 | 10/1938 | Neuendorf | 49/50 |
| 3,418,755 | 12/1968 | Di Chiaro | 49/501 |
| 3,918,202 | 11/1975 | Smith | 49/50 |
| 4,587,759 | 5/1986 | Gray | 49/501 |

*Primary Examiner*—Michael Milano
*Attorney, Agent, or Firm*—Norman St. Landau

[57] ABSTRACT

A high security multi-pane window and door system (10) describing a stationary outer frame (14) having sashes (15) mounted therein for relative translational movement. Each sash (15) includes a high strength grate (13) placed between two spaced and sealed panes (35) and the grate perimeter bars (33A, 33B, 33C) serving as a perimeter seal spacer bar for two spaced panes (35). A high strength elements system, being part of the high security multi-pane window and door system (10), and comprising: the grate (13) having attached with high strength joints a lock (61), trolleys (57), bottom and top interlocking elements (40, 41), interlocking with bottom and top channels (43, 69). The high strength elements system can not be disassembled nor opened while the lock bolt (49) is in locked position, even when ventilation gaps are left between the outer frame (14) and the sash (15). The high security multi-pane window and door system (10) incorporates thermo-insulating materials and features thermally broken design.

9 Claims, 4 Drawing Sheets

FIG 1

HIGH SECURITY MULTI-PANE WINDOW AND DOOR SYSTEM

BACKGROUND-FIELD OF INVENTION

This invention relates generally to multi-pane window and door systems. More specifically, the present invention is directed to an improved window and door system, having incorporated protective grate and lock systems therein.

BACKGROUND-DESCRIPTION OF PRIOR ART

Multi-pane window and door systems are known generally in the art. Such systems have two or more panes enclosed in wooden, metal, or plastic sash and frame. Operable and nonoperable window, or door grates are used separately from multi-pane window and door sashes. Glass windows and doors without additional grates are generally the easiest points for burglar and alike penetration into a building. Grates are often not allowed for aesthetical reasons. Electronic alarm systems, even if they work properly, usually do not resolve immediate penetration problem by burglar and alike. It takes time after activation of alarm systems for security, or else to show up and damage might be done.

OBJECTS OF INVENTION

It is an object of the present invention to provide high security, protective, insulated, multi-pane window and door assembly, having greatly improved resistance to burglar and alike penetration;

It is another object of the present invention to provide high security, protective, insulated, multi-pane window and door assembly which appears to be ordinary insulated, multi-pane, glass window, or door with colonial grids;

It is yet another object of the present invention to provide high security, insulated, multi-pane window and door assembly having good thermal, sound and weather insulating properties;

It is also an object of the present invention to provide high security, insulated, multi-pane window and door assembly having greatly improved resistance to burglar and alike penetration, both in locked position with no ventilation gap, or in positions with different sizes of ventilation gaps;

It is further another object of the present invention to provide high security, insulated, multi-pane window and door assembly having greatly improved strength, durability and deformation resistance.

SUMMARY OF INVENTION

The present invention is directed to an improved insulated, multi-pane window and door system having innovative safety features and substantially standard and defined thickness and frame sizes; good thermal insulation, weather resistance, strengths, durability and deformation resistance.

The improved, insulated, multi-pane, sliding window and door system comprises:

- a grate made of high strength material, having inner bars and perimeter bars, the former acting also as spacers for panes;
- first and second pane, each positioned on opposite side of the grate and contacting the perimeter bars of the grate by means of bounding material;

- the perimeter bars and the bounding material create a seal along the periphery of inner surfaces of the panes;
- a plastic, hollow core sliding sash frame encasing the panes and the grate;
- a plastic hollow core outer frame encasing the sliding sash frames;
- top and bottom channels, made of high strength material and incorporated into the plastic outer frame;
- a lock (key, combination - cypher, or magnetic) encased in cover made of high strength material and secured to the grate by means of high strengths joint;
- the sashes which can be locked in non venting position, or several venting positions;
- top interlocking elements, made of high strength material, secured to top of the grate, moving along and encased therein the top channels, the top interlocking elements can be replaced by two locks (with their lock bolts acting as interlocking elements);
- bottom interlocking elements, made of high strengths material, secured to the bottom of the grate, moving along and interlocking with the bottom channels, the bottom interlocking elements can be substituted by two locks having two movements of the lock bolt (with first movement the lock bolt acts as the interlocking element, with the second movement the lock bolt secures the sash in place to a building or other structure);
- trolleys, made of high strength material, secured to the bottom interlocking elements, and moving along the bottom channels.

DESCRIPTION OF PREFERRED EMBODIMENTS

Figure 1:
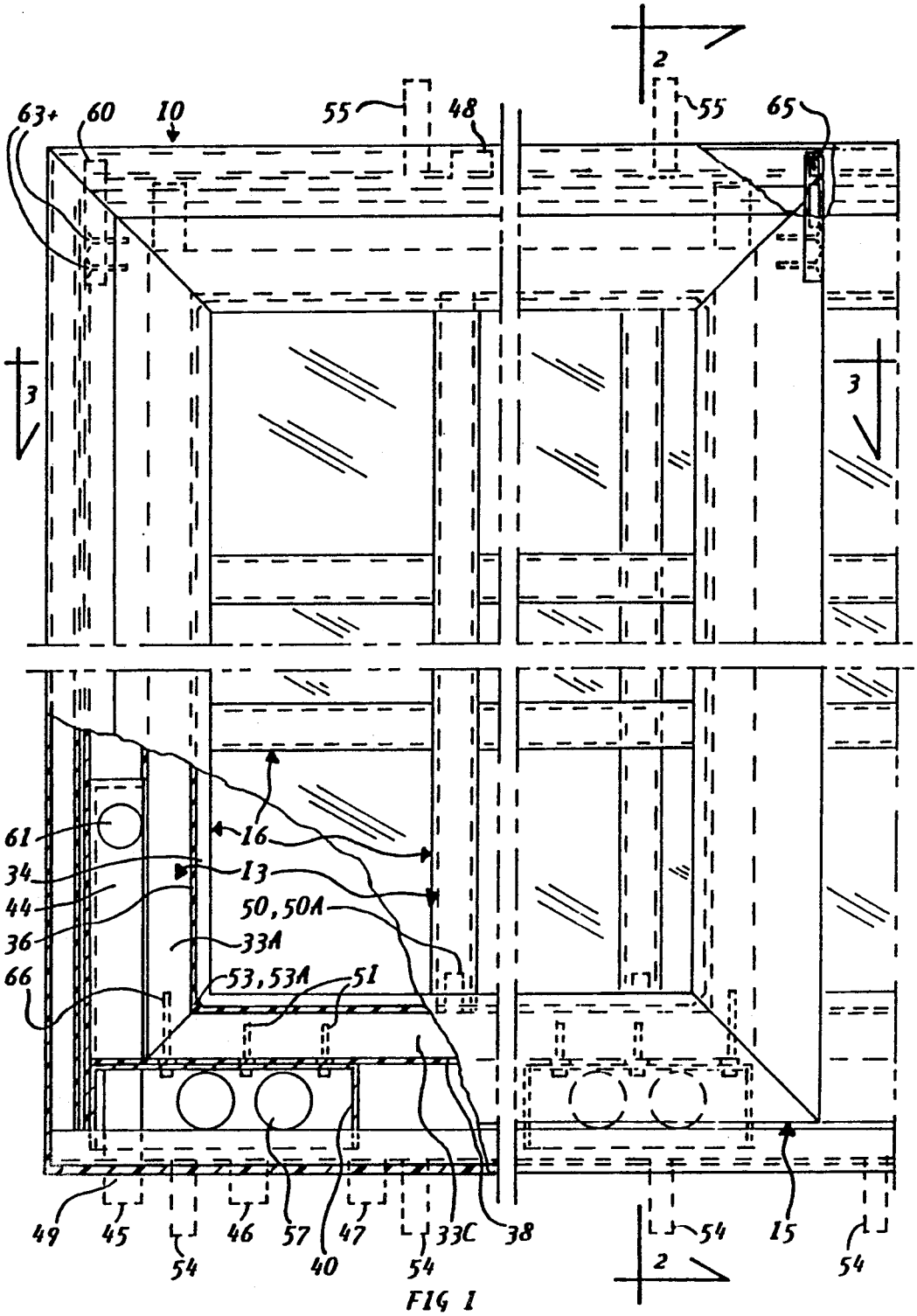
FIG. 1 shows an elevation view of the high security insulated multi-pane sliding window and door system, as seen from a house interior.

The present invention utilizes known materials (glass, bounding materials, lower strength materials having good thermal insulation properties e.g. plastics like PVC, high strength materials e.g. high strength steel and high strength corrosion resistant steel) and known assembly methods.

Novelty of the present invention comprises:

- joining the perimeter bars 33A, 33B, 33C, (FIG. 1, FIG. 2, FIG. 3) made of high strength material, to the inner bars 31 made of high strength material, with high strength joints, thereby creating the grate 13;
- placing the grate 13 between the two panes 35;

using the perimeter bars 33A, 33B, 33C of the grate 13, as spacers for the two panes 35;

creating the high security insulated multi-pane window and door system in which the interlocking elements 40, 41 of the grate 13 interlock with the channels 43, 69 embeded in the outer frame 14;

creating the high security insulated multi-pane window and door system in which the removable sashes 15, can not be removed in locked position of the lock 61, neither when the lock bolt 49 is in an opening 45 (non venting position), nor when the lock bolt 49 is in openings 46, 47 (venting positions);

creating the high security insulated multi-pane window and door system of which the high strength elements: the grate 13, the channels 43, 69 and the lock 61, can not be disassembled in the locked position of the lock 61, that means when the lock bolt 49 is in the openings 45, 46, 47;

creating the high security insulated multi-pane system-assembly, which appears to be ordinary dual-pane glass window or door with colonial grids, but has burglar and alike resistance as a high strength steel grate.

Figure 2:
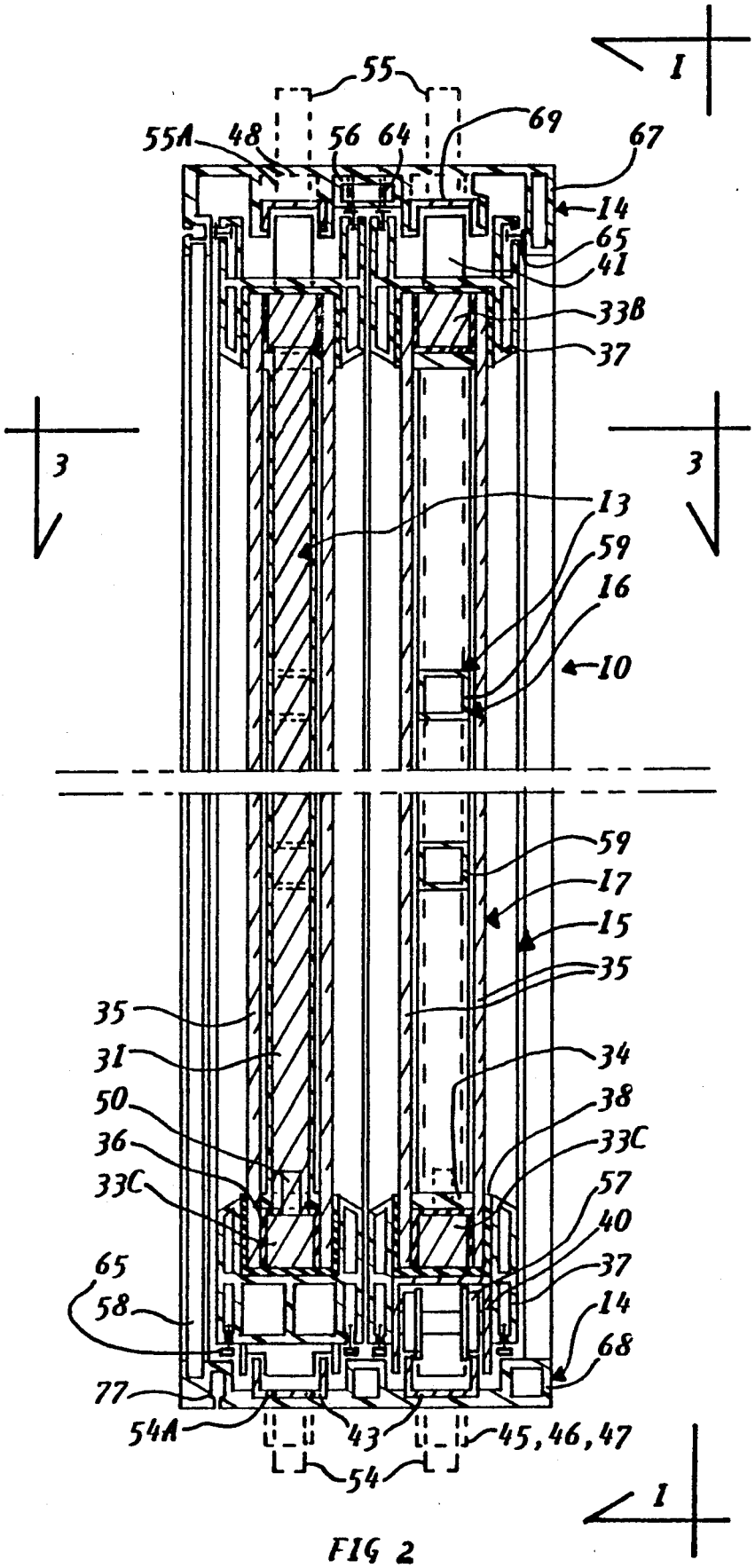
FIG. 2 shows a vertical cross-sectional view of the high security insulated multi-pane sliding window and door system shown in FIG. 1.
Figure 3:
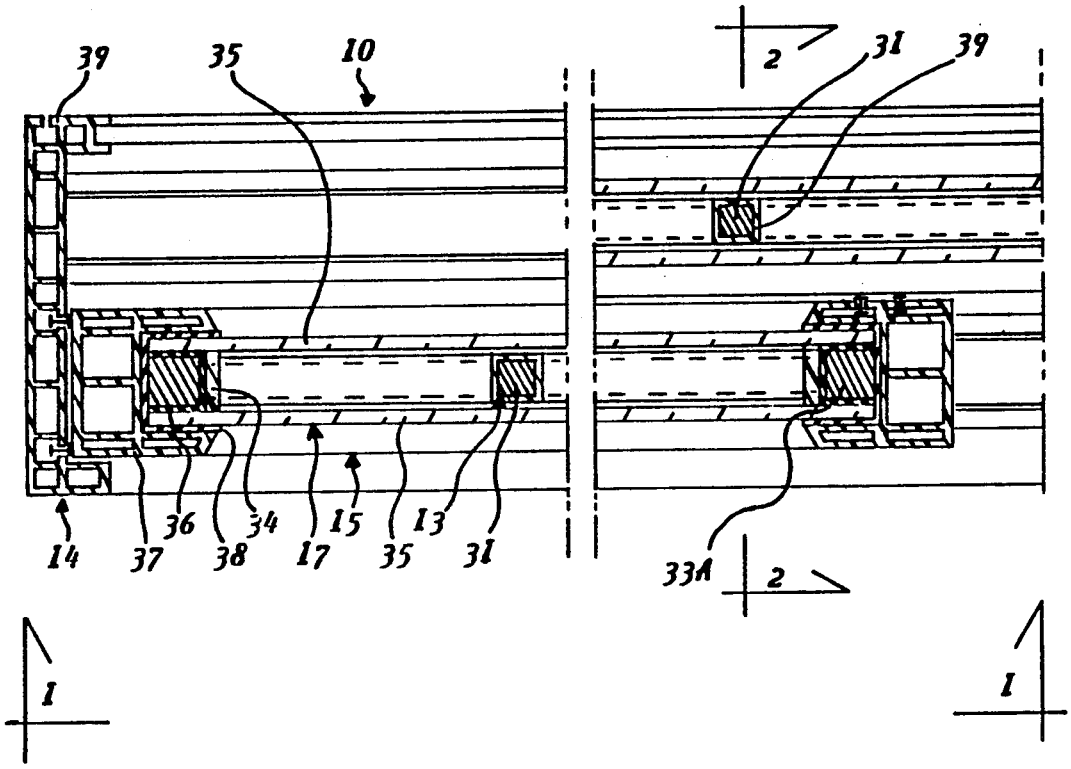
FIG. 3 shows a horizontal cross-sectional view of the high security insulated multi-pane sliding window and door system shown in FIG. 1.

Referring to FIG. 1, FIG. 2 and FIG. 3 (which are side view and two cross-sectional views of the same system) there is shown high security multi-pane sliding window and door system 10 as seen from interior of a building. The difference between the window system 10 and the door system 10 depends only on size of sashes, frames, trolleys and location of the system in a wall.

The basic element of the high security multi-pane sliding window and door system 10 is the grate 13, made of high strength material. The grate 13 comprises of the perimeter bars 33A, 33B, 33C (which act also as the pane spacers for the panes 35), the inner bars 31, the top interlocking elements 41, the bottom interlocking elements 40, the lock cover 44, and bolts 50, 51, 66. The perimeter bars comprise of side perimeter bars 33A, top perimeter bars 33B, and bottom perimeter bars 33C. All the perimeter bars 33A, 33B, 33C have mitered (at angle 45 degrees) ends. The top perimeter bar 33B is prewelded to the side perimeter bars 33A, the inner bars 31, and the top interlocking elements 41. The lock cover 44 is prewelded to the side perimeter bar 33A. The bottom perimeter bar 33C is prewelded to the bolts 50 in such arrangement, as to be locked into cutouts 50A of the inner bars 31.

The inner bars 31 (after preweldeing all elements: 31 and 33A to 33B, 44 to 33A, 50 to 33C) should be inserted therein hollow core plastic bars 39. The plastic bars 39 are integral part of a premoulded plastic grid 16. The premoulded plastic grid 16 consists of the hollow core plastic bars 39, welded to them hollow plastic bars 59, continuous plastic bars 34 prewelded to the bars 39 and 59. The continuous perimeter plastic bar 34 has mitered (at an angle 45 degrees) outside corners 53A to allow for better penetration of the bounding material 53. After inserting the plastic grid 16 onto the inner bars 31 (which form prewelded upper part of the grate 13, consisting of the bars 31, 33A, 33B, the lock cover 44, and the top interlocking elements 41), the lock 61 should be inserted into the lock cover. Then the lower interlocking elements 40 (containing the trolleys 57) should be bolted to the bottom perimeter bar 33C (using bolts 51), and the bottom perimeter bar 33C should be bolted to the side perimeter bars 33A (using bolts 66).

After the inner bars 31 are inserted into the plastic grid 16 and the grate 13 is assembled, the bounding material 36, 53 can be applied on surfaces of the perimeter bars 33A, 33B, 33C. Then the sealed double pane unit 17, having the plastic grid 16 and the grate 13 inbetween the panes 35 can be assembled.

The sealed double pane unit 17 is inserted into the side, top, and bottom sash frame 37 elements, which are welded together at their corners, forming in result the complete sash 15. Before welding of the sash frame 37 elements, gasket 38 is inserted between the sealed double pane unit 17 and the sash frame 37.

Basically the side, top and bottom elements of the sash frame 37 have the same design, dimensions and cross-sections. The differences being:

different weather stripping locations in the top, bottom and side elements of the sash frame 37;

cutouts for the bottom interlocking elements 40 in the bottom elements of the sash frame 37;

cutouts for sash cover elements 60 in the side and top elements of the sash frame 37 (the sash cover elements 60 secured with bolts 63, are installed to improve thermal insulation of the system 10);

longitudinal cutout in the top component of the sash frame 37 to allow installation and removal of the sash 15:

cutout (in the side and bottom elements of the sash frame 37) to accommodate the lock cover 44.

The outer frame 14 (made of lower strength material having good thermal insulation properties e.g. plastic like PVC) of the system 10, having inserted the bottom channels 43 and the top channels 69 (made of high strength rigid material) in the top outer frame elements 67 and the bottom outer frame elements 68. Inserting high strength material elements into side elements of the outer frame 14 is optional depending on conditions, they can be bolted to the bottom channels 43, the top channels 69 and are especially needed, when several of the system 10 doors and, or windows are grouped in a row side by side. The top outer frame elements 67 and the top channels 69 have cutouts 55A to accommodate bolts 55 fastening the outer frame 14 to a building or other structure, and the cutouts 48 to allow removal of the sash 15. There There are three or more outer frame cover elements 56 (installed to improve thermal insulation of the system 10). The outer frame cover elements are fastened to the top outer frame element 67 with bolts 64.

The bottom outer frame element 68 and the bottom channel 43 have cutouts 54A to accommodate bolts 54 fastening the outer frame 14 to a building or other structure, and the openings 45, 46, 47 to accommodate the lock bolt 49. Location of the openings 46 and 47, should be such, that not to allow for ventilation gap larger than 4 inches (101.6 millimeters).

Location of the cutouts 54A, 55A, the bolts 54, 55 should be such, that not to allow for disassembling of the system 10, while the lock bolt 49 is in one of the openings 45, 46, 47. At least two bolts 54 should be covered by the lower interlocking elements 40 of each sash 15 and at least two bolts 55 should be covered by each sash 15 everytime, while the lock bolt 49 is in one of the openings 45, 46, 47. Length of the bolts 54 and 55 should be more than 4 inches (101.6 millimeters).

Location of the cutouts 48 should be such, that not to allow for the sash 15 removal, while the lock bolt 49 is in locked position in any of the openings 45, 46, 47. In order to remove the sash 15 from the outer frame 14, the bolts 63, 64, the outer frame cover elements 56 and the sash cover elements 60 must be removed. Then the cutouts 48 and the bolts 41 should be lined up. The sash 15 (the one closer to a building interior) should be lifted up, so the bolts 41 penetrate into the cutouts 48. Next the sash 15 (while lifted) should be rotated (along a contact line of the bolts 41 and the cutouts 48) and moved towards interior of the house (or other structure) to complete removal of the sash 15. The same procedure should be carried out to remove the remaining sashes 15. The reverse procedure should be carried out to install the sashes 15.

The outer frame 14 has provision for screen panels 58.

Figure 4:
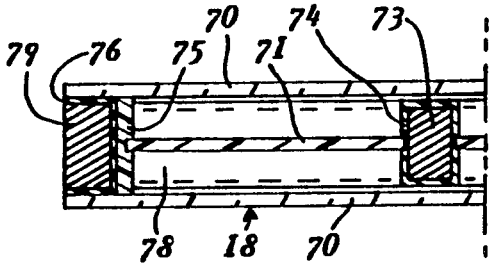
FIG. 4 shows a horizontal cross-sectional detail view of a triple-pane version of the high security insulated window and door system.

For better thermal insulation and cutting on noise (while operating the system 10) the top interlocking elements 41 and the top channels 69 should be covered with plastic. Referring to the FIG. 4 of the drawings, there is shown detail cross-sectional view of a sealed triple pane unit 18. Therein is an inner pane 71, inserted into the plastic hollow core bars 74, 78, and the plastic perimeter bar 75. An inner pane 71 is placed between, spaced apart from and parallel to the outer panes 70. Other elements shown in FIG. 4 (placed and joined in the same way as described for FIG. 1, FIG. 2 and FIG. 3) are:

the bounding material 76;

the perimeter bar 79, made of high strength rigid material.

the inner bar 73, made of high strength rigid material;

The sealed triple pane unit 18 incorporating the grate system is meant, as an alternative to the sealed double pane unit 17, to be used in the high security multi-pane window and door system.

Figure 5:
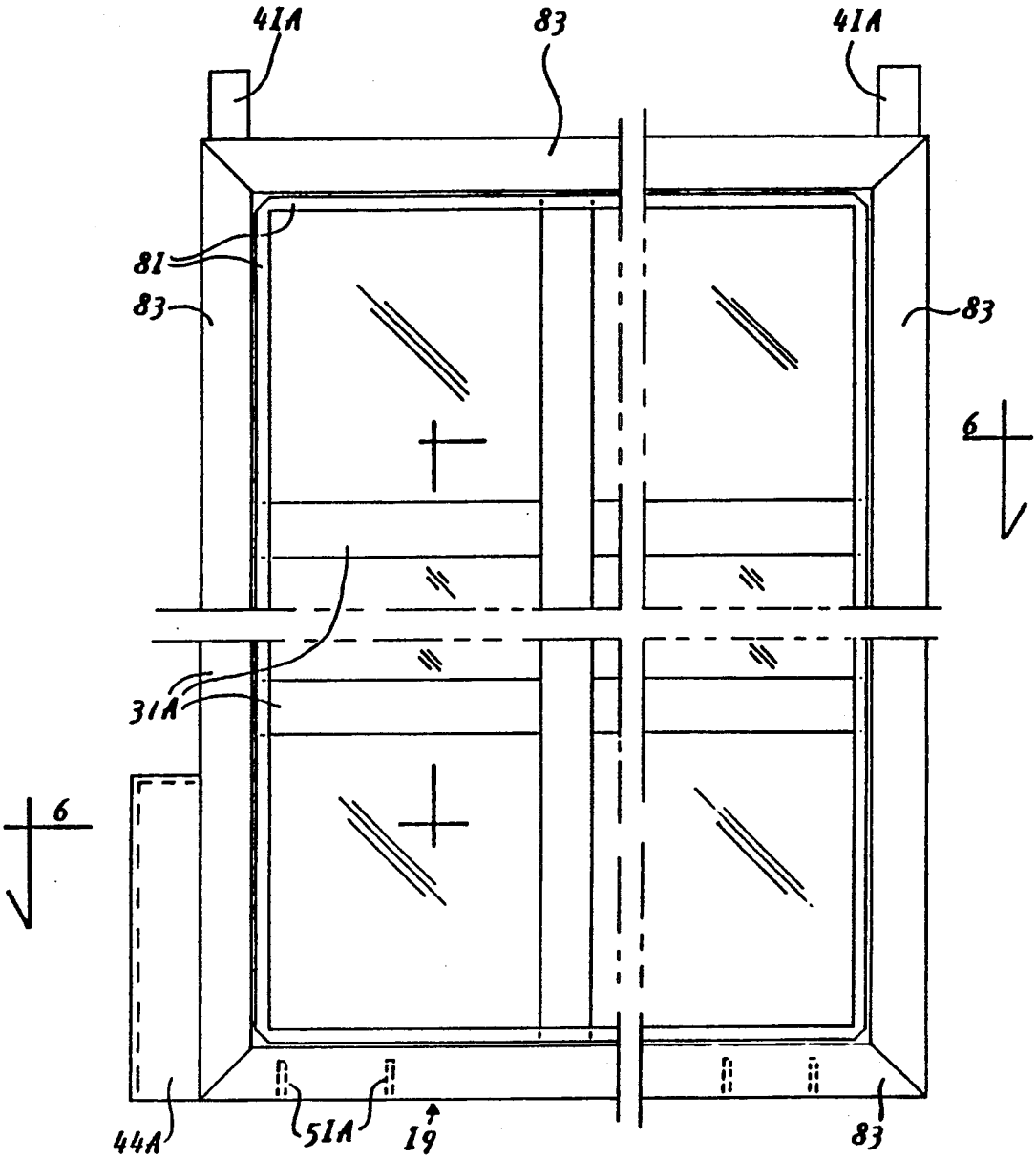
FIG. 5 shows an alternative grate design (to the grate design shown in FIG. 1) for the high security insulated multi-pane window and door system.
Figure 6:
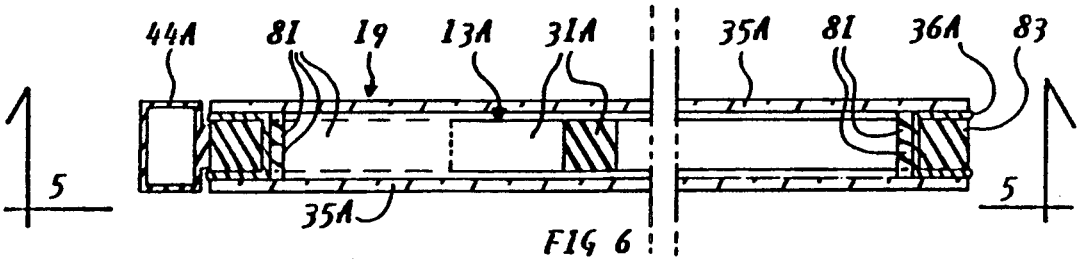
FIG. 6 shows a horizontal cross-sectional view of the alternative grate design shown in FIG. 5.

Referring to FIG. 5 and FIG. 6 (which are side view and horizontal cross-section), there is shown the sealed double-pane unit 19 (incorporating grate 13A) meant as an alternative to the sealed double-pane unit 17, and the sealed triple-pane unit 18, to be used in the high security multi-pane window and door system. The grate 13A, of the sealed, double-pane unit 19, comprises of the inner bars 31A and the perimeter bars 83. The inner bars 31A and the perimeter bars 83 are made of high strength rigid material. The inner bars 31A and the perimeter bars 83 are placed in the same plane connected thereto using high strength joints (e.g. by welding). All visible surfaces of the grate 13A should be smooth and should be covered with decorative resilient coat (e.g. lacquer). The sealed double-pane unit 19 comprises:

the grate 13A;

the perimeter bar 81 (made of lower strength material comprising of two parts (each mounted from an opposite side of the grate 13A) placed along an inside surface of the perimeter bars 83;

the first and second pane 35A, spaced in parallel relationship to each other and having the grate 13A inbetween and in parallel relation thereto;

the bounding material 36A placed between and in contacting relationship to the perimeter bars and the panes 35A;

the lock cover 44A prewelded to the side component of the perimeter bar 83;

the top interlocking elements 41A prewelded to the top component of the perimeter bar 83;

bolt housing 51A for mounting the bottom interlocking elements shown in FIG. 1.

The inner bars 31A and the perimeter bars 83 should be spaced approximately 0.0787 inches (2 millimeters) from each of the panes 35A.

The hollow core plastic bars 39, 59, 74, 78 should be spaced from the panes 35, 70 approximately 0.0787 inches (2 millimeters).

The inner bars 31, 73, 31A, the perimeter bars 33A, 33B, 33C, 79, 83, the lock covers 44, 44A, the bolts 50 should be made of high strength substantially rigid material protected against corrosion (e.g. galvanized high strength steel).

The top channels 69, the bottom channels 43, the trolleys 57, the bottom interlocking elements 40, the top interlocking elements 41, 41A, the bolts 49, 51, 54, 55, 63, 64, 66, should be made of high strength noncorrosive substantially rigid material (e.g. high strength noncorrosive steel).

The inner bars 31, 31A, 73, and the outer bars 33A, 33B, 33C, 79, 83, can be full core or hollow core.

The plastic grid 16, the outer frame 14, the sash frame 37, the plastic hollow core bars 74, 78, the plastic perimeter bars 75, 81, should be made of plastic (e.g. PVC).

The outer frame 14 has provision for snap in elements 77, (e.g. mullions, moldings, flashings, screen mounts, combinations of thereof, and alike). In case the provision for snap in elements 77 is used for mounting screen panels, the provision for screen panels 58 might be eliminated.

The sash 15 should have thickness from 2 inches to 3 inches (from 50.8 to 76.2 millimeters), the sealed multi-pane unit 17, 18, 19 should have thickness from 1 inch to 2 inches (from 25.4 to 50.8 millimeters), the outer frame 14 should be from 5 inches to 6 inches (from 127 to 152 millimeters) thick.

The inner bars 31, 31A, 73, the outer bars 33A, 33B, 33C, 79, 83, are spaced to obstruct passage of any object larger than approximately 5 inches by 8 inches (203 by 127 millimeters).

Different handle provisions might be used for the sash frame 15.

Drainage openings should be incorporated to frames for discharge of accumulated moisture.

The top channels 69 and the bottom channels 43, may in general be extruded elements made of high strength substantially rigid material.

The high strength joints may in general be high securing means.

The bounding material 36, 53, 36A, may in general be bounding means.

When one of the openings 45, 46, 47, accommodates the lock bolt 49, of the lock 61, in general, the locked mode position is in effect.

Access code means may in particular be: a key to the mechanical lock, or a numerical combination code to the numerical lock and alike.

The high strength element system can comprise of e.g. the top channels 69, the bottom channels 43, the grate 13, the lock 61, the lock bolt 49, their components and relations between these components as stated in description to FIG. 1, FIG. 2, FIG. 3.

For better insulating properties: low E glass, plastic panes (especially between outer panes), noble gases (e.g. argon) in space between panes, and foam insulation to fill hollow cores in the frames might be used.

For aesthetic considerations inside wood veneer, inside and, or outside snap in grids might be used.

The high security multi-pane window and door system described therein, can be used for: double-hung windows, casement windows, awning windows, swing pane doors and alike using the same basic claims of this invention.

Although the invention has been described in specific terms, it will be understood that various changes may be made in size, shape, materials, types of windows and doors, and in the arrangement of the parts without departing from the spirit and the scope of the invention as claimed.

I claim:

1. A high security multi-pane window and door system, said system comprising:

first and second panes in closely spaced apart, substantially parallel relationship, each pane having an inner surface with the inner surfaces of the panes facing each other;

a grate made of high strength substantially rigid material, between and in substantially parallel relationship to said first pane and said second pane, said grate being spaced slightly from each of said panes to create a thermal break therebetween, said grate comprising inner bars connected to perimeter bars, said inner bars and said perimeter bars being secured together by means of high strength joints at points of their intersection; and a seal between and in contacting relationship with said first pane and said second pane along the periphery of the inner surfaces of said first pane and said second pane, said seal comprising of said perimeter bars and bounding means, said bounding means being between and in contacting relationship with said perimeter bars and the inner surfaces of said first pane and said second pane.

2. The system of claim 1 further comprising:

a sash frame encasing the perimeter of said first pane, said second pane and said seal, said sash frame having good thermo-insulating properties;

a sash comprising said sash frame, said first pane, said second pane, said seal and said grate;

an outer frame having good thermo-insulating properties and incorporating elements being made of high strength substantially rigid material;

means providing for relative movement between said outer frame and said sash;

high strength means for securing said outer frame elements to a supporting structure; and locks which when in a locked mode position, securing by high strength securing means said grate to said outer frame elements, in the vicinity of said high security multi-pane window and door system said locks can not be operated without access code means; and outer frame elements, said grate, said locks, said locked mode positions and said high strength securing means comprise a high strength element system being an integral part of said high security multi-pane window and door system, said high strength element system having thereof components positioned in such a way that does not allow removal of any components thereof while said locks are in said locked mode position, said high strength element system having components positioned and spaced in such a way, that a human being can not pass therethrough while said locks are in said locked mode positions, even if said first pane, said second pane, said sash frame and said outer frame are removed.

3. The system of claim 2 further including interlocking elements made of high strength substantially rigid material and secured to said perimeter bars of said grate by said means of high strength securing means, said interlocking elements being an integral part of said high strength element system, and interlock with said outer frame elements.

4. The system of claim 2 wherein said locked mode positions of said lock are arranged in such a way to allow for multitude of sizes of ventilation gaps between said outer frame and said sash frame, said ventilation gaps have the sizes not allowing for passage of a human being through, even if said outer frame, said first pane, said second pane and said sash frame are removed.

5. The system of claim 2 further including removal cutouts positioned in said outer frame and said outer frame elements, to facilitate removal of said sashes from said outer frame, said removal cutouts being spaced in such a way, that said sashes can not be removed from said outer frame while said locks are in said locked mode positions, said high security multi-pane window and door system including cover elements, said cover elements being meant to improve thermo-insulating properties of said high security window and door system.

6. The system of claim 2 wherein said locks made of high strength material being inserted into lock covers, said lock covers made of high strength material being secured to said perimeter bars by the high strength means.

7. The system of claim 2 wherein said sash frame and said outer frame being made of extruded plastic and including multitude of weather-stripping.

8. The system of claim 2 further including a hollow core grid being made of decorative material and covering visible, after said sash assembly, surfaces of said inner bars and said perimeter bars.

9. The system of claim 8 further including multiple panes positioned in the plane of said grate, spaced from and placed in between said first pane and said second pane, and mounted into said hollow core grid.

* * * * *